United States Patent [19]

Simon et al.

[11] 4,274,926

[45] Jun. 23, 1981

[54] PROCESS FOR THE ELECTROLYTIC DEPOSITION OF SILVER AND SILVER ALLOY COATINGS AND COMPOSITIONS THEREFORE

[75] Inventors: Franz Simon, Schmitten; Manfred Schmidt, Rodenbach, both of Fed. Rep. of Germany

[73] Assignee: Degussa Aktiengesellschaft, Frankfurt, Fed. Rep. of Germany

[21] Appl. No.: 135,765

[22] Filed: Mar. 31, 1980

[30] Foreign Application Priority Data

Apr. 12, 1979 [DE] Fed. Rep. of Germany ..... 2914880

[51] Int. Cl.[3] ..... C25D 3/66

[52] U.S. Cl. ..... 204/39

[58] Field of Search ..... 204/39, 64 R, 71

[56] References Cited

U.S. PATENT DOCUMENTS 4,149,942 4/1979 von Stutterheim ..... 204/39 X

*Primary Examiner*—G. L. Kaplan

*Attorney, Agent, or Firm*—Cushman, Darby & Cushman

[57] ABSTRACT

There are needed galvanic baths for the deposition of silver and silver alloys which exhibit a high resistance to sulfur and contain the least possible amounts of alloyed platinum group metals and/or gold. This is attained by using a salt melt as the electrolyte which melt contains a silver salt, alkali thiocyanate and salts of at least one alloying metal. Preferably the electrolyte contains per liter of salt melt 0.1 to 40 grams of silver and 1 to 200 grams of platinum metal and/or gold.

22 Claims, No Drawings

PROCESS FOR THE ELECTROLYTIC DEPOSITION OF SILVER AND SILVER ALLOY COATINGS AND COMPOSITIONS THEREFORE

BACKGROUND OF THE INVENTION

The invention is directed to a composition and process for the electrolyte deposition of silver and silver alloy coatings out of an electrolyte that contains or consists of a salt melt.

Because of their high electrical conductivity and good resistance to oxidation silver and silver alloys are among the most important electrical contact materials in the electrolyte art. Additionally the price of silver is relatively low compared to other noble metals.

Limiting the use of silver is the low resistance of silver in sulfur containing atmosphere. There occurs through the silver sulfide tarnish layer formed thereby not only a discoloration of the surface but also an increase of the electrical contact resistance of these coatings.

In the energy art where high current flows at relatively high contact forces these sulfidic tarnish coatings cause only slight disturbance.

It is different in the weak current art where it is important that at low contact strengths the contact resistance remains small and constant.

Metals which form alloys with silver that increase essentially are the platinum group of metals, e.g. platinum, palladium or ruthenium, as well as gold. To be sure for example a metallurgical melt produced silver-palladium alloy is only resistant to sulfur if the palladium component is more that 30 weight %. Such alloy coatings also can be applied galvanically but these silver alloy coatings have the disadvantage if they are deposited in a wet galvanic method that to reach the same resistance to sulfur the portion of alloying metal, thus e.g. palladium, according to experience must be higher than in the melted alloys.

Therefore it was the problem of the present invention to develop a process for the electrolytic deposition of silver and silver alloy coatings by which sulfur resistant coatings could be produced with the least possible portion of alloyed platinum group metals and/or gold.

SUMMARY OF THE INVENTION

This problem was solved according to the invention by providing an electrolyte which comprises or consists of a salt melt which contains a silver salt, alkali metal thiocyanate and in a given case one or more alloying metals.

In selecting the range of operating temperature care must be taken that diffusion does not simultaneously occur in which the customarily used substrate materials are concerned. Alkali thiocyanate melts make possible preeminently working temperatures in the range of 100° to 200° C., at which homogeneous silver alloy coatings are formed and on the other hand diffusion involving the substrate does not occur.

Preferably the electrolyte contains 0.1–40 grams of silver per liter of salt melt in the form of a thiocyanate, cyano and/or chloro compound of silver e.g. silver chloride, silver cyanide, potassium silver cyanide, silver bromide, silver thiocyanate and sodium silver cyanide. Particularly proven good are baths containing 0.5 to 20 grams of silver per liter of salt melt.

As alkali thiocyanate there is advantagouesly used a mixture of 70 mol % potassium thiocyanate and 30 mol % sodium thiocyanate having a melting point of about 125° C. However, there can also be used other mixture ratios and other thiocyanate components for the process of the invention. There can also be used sodium thiocyanate or potassium thiocyanate individually.

It has proven especially advantageous if there is added to the electrolyte up to 200 grams of alkali cyanide, e.g. sodium cyanide or potassium cyanide, per liter of salt melt and/or up to 300 ml of water per liter of salt melt. Thus when alkali cyanide is present it is usually present in an amount of at least 25 grams per liter of salt melt. Likewise when water is present, it is usually present in an amount of at least 20 grams per liter of salt melt.

As alloying metals there are usable silver, palladium, ruthenium, platinum and/or gold in amounts of 1 to 200 grams, in the form of a salt soluble in the salt melt. Particularly recommended are the thiocyanato, chloro, sulfato and/or cyano compounds of these metals, e.g. compounds such as gold (I) cyanide, gold (I) thiocyanate, gold (I) chloride, gold (III) chloride, gold (I) sulfate, gold (III) thiocyanate, gold III (cyanide), palladium chloride, palladium cyanide, ruthenium cyanide, platinum (II) cyanide, platinum (II) sulfate, platinum (II) chloride, potassium gold (I) cyanide and sodium gold (I) cyanide.

The deposition takes place preferably at temperatures of 100° to 200° C., especially at 130° C. Advantageously there are employed hereby insoluble anodes e.g., carbon on platinited titanium.

With the process of the invention there can be deposited tarnish resistant silver coatings which contain relatively little alloying metal.

X-ray examinations on the thus produced silver alloy coatings show that the structure is substantially homogeneous and a mixed crystal formation has occurred.

Unless otherwise indicated all parts and percentages are by weight.

The composition can comprise, consist essentially of or consist of the materials set forth and the process can comprise, consist essentially of or consist of the steps set forth with said materials.

The following examples further describe the process of the invention.

DESCRIPTION OF THE PREFERRED EMBODIMENTS

Example 1

1 kg of a mixture of KSCN and NaSCN (70:30 mole %) was melted and brought to a temperature of 130° C. while adding 150 ml of water. Subsequently there were added 1 grams of silver as $K[Ag(CN)_2]$ as well as 10 grams of Pd as $Pd(CN)_2$. At a current density of 0.6 $A/dm^2$ to 1.0 $A/dm^2$ there deposited on gold-plated Ni under layer silky lustered Ag-Pd alloy coatings containing 20–30% Pd. As insoluble anode material platinited titanium is used.

Example 2

1 kg of pure KSCN was melted with the addition of 150 ml of water and brought to 130° C. After the addition of 4 grams of silver as $K[Ag(CN)_2]$, 20 grams of Au as $K[Au(CN)_2]$ and 25 grams of KCN at current densities of 0.5 $A/dm^2$ to 1.2 $A/dm^2$, there were deposited on gold-plated Ni as an undercoating Ag/Au alloys having 20–30% Au. Both coatings show a resistance to sulfur in a corrosion test. As insoluble anode material platinited titanium is used.

The entire disclosure of German priority applications Ser. No., P2914880.9 is hereby incorporated by reference.

What is claimed is:

1. A composition suitable for the electrolytic deposition of silver or a silver base alloy comprising an electrolyte which is a salt melt bath and consists essentially of a silver salt and an alkali metal thiocyanate or a mixture of a silver salt, alkali thiocyanate and a salt of at least one metal forming an alloy with silver and which salt melt bath contains water in amount of 20 to 200 ml per liter of melt.

2. A composition according to claim 1 wherein the electrolyte contains 0.1 to 40 grams of silver per liter of salt melt, the silver being present as a thiocyanato, cyano or chloro silver compound or as a mixture thereof.

3. A composition according to claim 2 wherein the electrolyte contains 0.5 to 20 grams of silver per liter of salt melt.

4. A composition according to claim 2 wherein the alkali metal thiocyanate is present as a mixture of 70 mole % potassium thiocyanate and 30 mole % of sodium thiocyanate.

5. A composition according to claim 2 wherein alkali metal cyanide is also present and is present in an amount up to 200 grams of alkali cyanide per liter of melt.

6. A composition according to claim 5 wherein water is present in an amount of 150 ml of water per kilogram of alkali metal thiocyanate.

7. A composition according to claim 2 wherein the water is present in an amount of 150 ml of water per kilogram of alkali metal thiocyanate.

8. A composition according to claim 2 wherein there is present in the salt melt a soluble salt of palladium, ruthenium or platinum or a mixture of such soluble salts, said soluble salt being present in an amount of 1 to 200 grams per liter of salt melt.

9. A composition according to claim 8 wherein the water is present in an amount of 150 ml per kilogram of alkali metal thiocyanate.

10. A composition according to claim 8 wherein the soluble salt is a thiocyanate, chloride, sulfate or cyano compound.

11. In a process of electrolytically depositing silver or a silver base alloy coating, the improvement comprising employing as the electrolyte the composition of claim 1.

12. In a process of electrolytically depositing silver or a silver base alloy coating, the improvement comprising employing as the electrolyte the composition of claim 2.

13. In a process of electrolytically depositing silver or a silver base alloy coating, the improvement comprising employing as the electrolyte the composition of claim 3.

14. In a process of electrolytically depositing silver or a silver base alloy coating, the improvement comprising employing as the electrolyte the composition of claim 4.

15. In a process of electrolytically depositing silver or a silver base alloy coating, the improvement comprising employing as the electrolyte the composition of claim 5.

16. In a process of electrolyticaly depositing silver or a silver base alloy coating, the improvement comprising employing as the electrolyte the composition of claim 6.

17. In a process of electrolytically depositing silver or a silver base alloy coating, the improvement comprising employing as the electrolyte the composition of claim 7.

18. In a process of electrolytically depositing silver or a silver base alloy coating, the improvement comprising employing as the electrolyte the composition of claim 8.

19. In a process of electrolytically depositing silver or a silver base alloy coating, the improvement comprising employing as the electrolyte the composition of claim 9.

20. In a process of electrolytically depositing silver or a silver base alloy coating, the improvement comprising employing as the electrolyte the composition of claim 10.

21. In a process of electrolytically depositing silver or a silver base alloy coating, the improvement comprising employing as the electrolyte the composition of claim 10 and the process is carried out at 100° to 200° C.

22. In a process of electrolytically depositing silver or a silver base alloy coating, the improvement comprising employing as the electrolyte the composition of claim 2 and the process is carried out at 100° to 200° C.

* * * * *